US005487474A

United States Patent [19]

Heimendinger

[11] Patent Number: 5,487,474

[45] Date of Patent: Jan. 30, 1996

[54] DEVICE FOR DISPLAYING ARTICLES

[75] Inventor: Bernard Heimendinger, Montmorency, France

[73] Assignee: FAPEC, Montmorency, France

[21] Appl. No.: 239,620

[22] Filed: May 9, 1994

[51] Int. Cl.[6] ..... A47F 5/00

[52] U.S. Cl. ..... 211/59.2; 211/1.57; 211/150

[58] Field of Search ..... 211/59.2, 150, 211/74, 1.57; 248/242; 108/6, 7, 8

[56] References Cited

U.S. PATENT DOCUMENTS

| | | | |
|---|---|---|---|
| 3,111,915 | 11/1963 | Gray | 211/59.2 X |
| 3,981,511 | 9/1976 | Foster | 211/150 X |
| 4,067,265 | 1/1978 | Watson | 211/150 X |
| 4,191,296 | 3/1980 | Morgan | 211/150 X |
| 4,627,542 | 12/1986 | Fredrickson | 211/59.2 X |
| 4,793,497 | 12/1988 | Hall et al. | 211/150 |
| 5,013,983 | 5/1991 | Futch et al. | 211/1.57 X |
| 5,531,646 | 7/1985 | Howard | 211/150 |

*Primary Examiner*—Robert W. Gibson, Jr.
*Attorney, Agent, or Firm*—Dressler, Goldsmith, Shore & Milnamow, Ltd.

[57] ABSTRACT

The display cabinet includes a fixed frame with front vertical stanchions 2 bearing fixed load or feeding bars 20 which support the front end of display racks 22. A mobile frame including rear vertical stanchions 10 is able to move vertically with respect to the fixed frame and bears load bars 25 supporting the rear end of the racks 22. A motor borne by the fixed frame rotary-drives an endless screw engaged in a nut integral with the mobile frame so that, depending on its direction of rotation, the motor moves the mobile frame either upwards or downwards. In the top position of the mobile frame, the racks 22 are slanted forwards by propelling the bottles 35 they contain by means of gravity in this direction. When the mobile frame is in the bottom position, the racks are slanted towards the rear allowing for easy loading, the bottles 35 being propelled via their weight towards the rear.

3 Claims, 5 Drawing Sheets

FIG.4
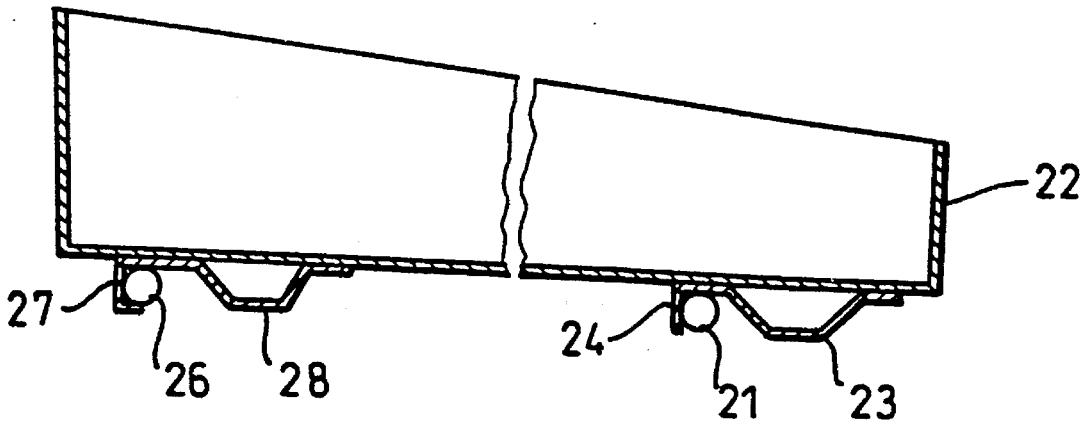
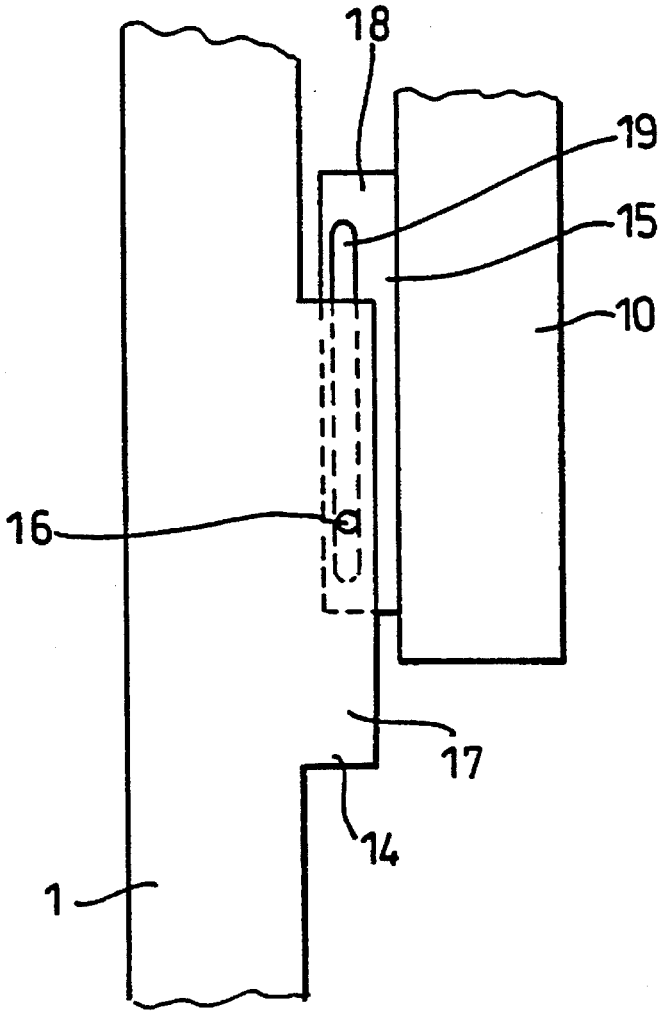
FIG.5

DEVICE FOR DISPLAYING ARTICLES

The present invention concerns a display cabinet able to display the sale of miscellaneous items and more particularly concerns a display cabinet used in large stores and whose display racks are relatively deep, thus prohibiting or rendering it difficult for customers to gain access to the articles located at the rear portion of these racks.

Such display cabinets are known with display racks which comprise a certain degree of slanting towards the front, this disposition having the advantage of, whenever a customer picks up articles situated at the front portion of the rack, that is those within hand's reach, enabling these articles to be located automatically and immediately replaced by those items located further back and which move via gravity to the front portion of the display rack. Accordingly, until these racks are completely empty, the articles they contain are still placed at their front portion where they can be easily picked up by customers.

However, these display cabinets with display racks slanted forwards have one significant drawback concerning their reloading. In fact, during the reloading operation, new articles are gradually placed in the display rack and slide towards the front via gravity so that, in order to reload a column of articles in the rack, an operator needs to use one hand to push back towards the rear the articles of this column already in place so as to provide a location towards the front before placing a new article with his/her other hand. This operation is repeated until the column of articles is full and it can be readily understood that the more articles of the column are to be pushed towards the rear, the more physical effort is required (these articles may, for example, be full bottles weighing more than 1.5 kg), thus increasing the time required for the reloading operation. The operation is then repeated for each column of articles inside the display rack and then for each rack of the display cabinet which results in losing a considerable amount of time.

The object of the present invention is to resolve these drawbacks of display devices with forward slanting and to this effect provides a device of this type which, whilst being simpler in design and less costly, may be reloaded simply and quickly without an operator having to resort to using any significant physical effort.

Accordingly, the device of the invention comprises a fixed frame bearing at least one display rack having towards the front an inclination with respect to horizontal so that the articles contained in said rack automatically move via gravity towards the front of the rack and is characterized by a device controlling a tilting of said rack towards the rear as far as a position where the latter is slanted towards the rear with respect to horizontal by a value approximately equivalent to that of said slanting towards the front thus allowing for easy reloading of said rack by articles which, via gravity, automatically move towards the rear portion of the rack. Once the reloading operation has been completed, said device enables said rack to be returned to its normal usage front slanting position.

Advantageously, one end of the racks of the display device (preferably the front end) is supported by a fixed frame, whilst the opposing end of the racks is supported by a vertically mobile frame, the rising or falling movement of this mobile frame tilting each display rack towards the front or rear around its support on the fixed frame.

So as to clearly understand the device of the invention, there now follows a non-restrictive example of a preferred embodiment with reference to the accompanying diagrammatic drawings on which:

FIG. 4 is on larger scale a transverse vertical cutaway view of a rack equipping the display cabinet of FIGS. 1 to 3, FIG. 5 shows on larger scale the system for guiding the vertical movement of the mobile frame;

Figure 1:
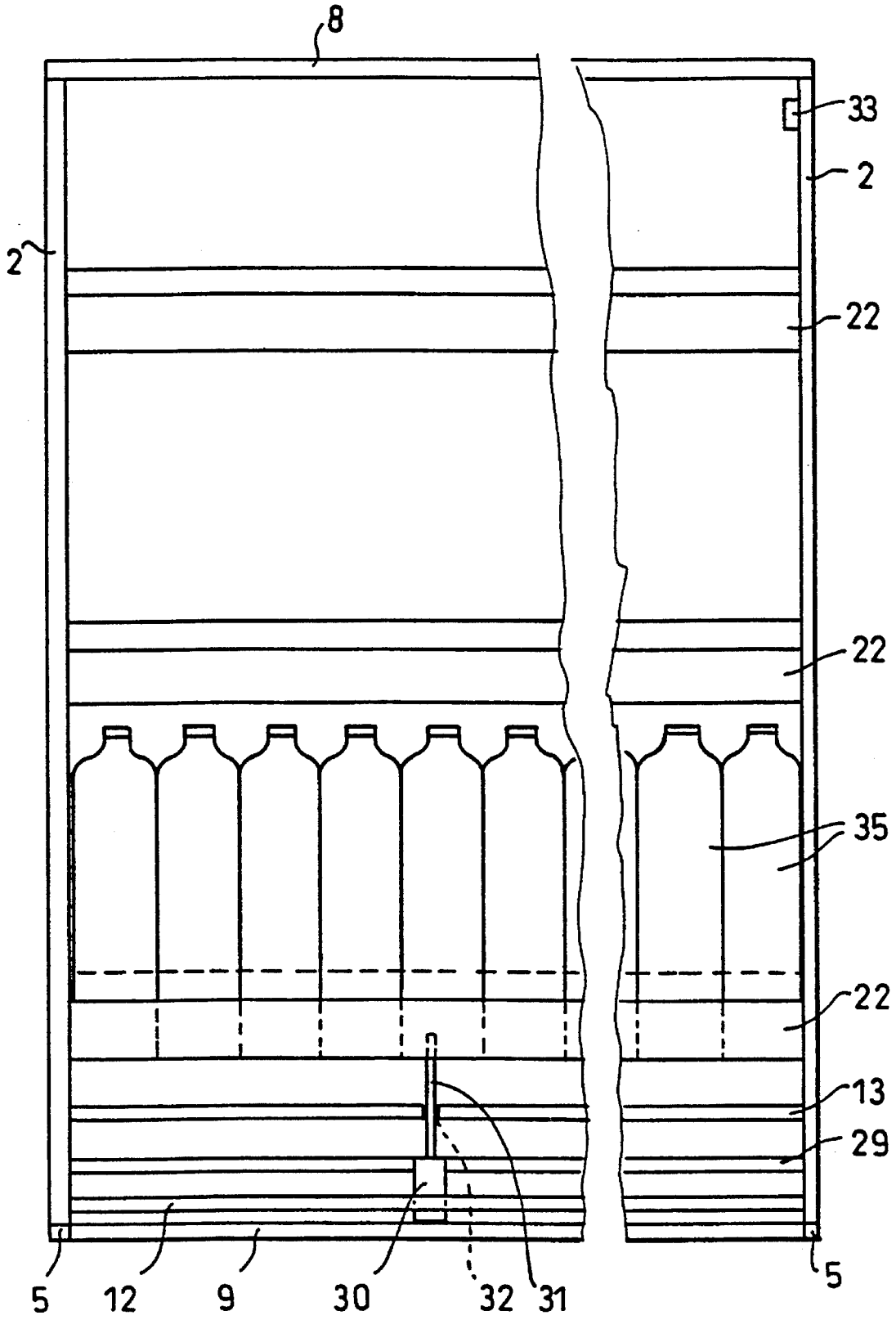
FIG. 1 is a front view of a display cabinet according to the invention and intended for the sale of bottles.

With reference to the drawing, the display cabinet of the invention includes a fixed frame constituted on each side by two rear vertical stanchions 1 and two front vertical stanchions 2 connected at their upper and lower ends by crossmembers 3 and 4 respectively. Each lower crossmember 4, used as support feet on the ground, has an elongation 5 towards the front. The rear vertical stanchions 1 are connected together by upper 6 and lower 7 side members, and similarly the front vertical stanchions 2 are connected together by upper 8 and lower 9 side members so that the fixed frame thus embodied is particularly sturdy.

Slightly in front of the rear vertical stanchions 1 is a mobile frame inside a vertical plane parallel to the plane containing the rear stanchions 1. This mobile frame is constituted by two vertical stanchions 10 braced by upper 11, lower 12 and intermediate 13 side members. The vertical movement of the mobile frame is guided over a limited path by means of the cooperation of upper and lower guiding members 14 borne by the front face of the fixed rear stanchions 1 with corresponding upper and lower guiding members 15 borne by the rear face of the mobile vertical stanchions 10. Each guiding member 14 includes a horizontal spindle 16 parallel to the side members 6 and 7 and connecting two parallel cheeks 17 which extend the stanchion 1 towards the front, whereas each guiding member 15 includes a vertical plate 18 extending the vertical stanchion 10 towards the rear and being engaged between the cheeks 17. The plate 18 axially has an oblong slit 19 inside which the spindle 16 is able to move during a relative movement.

Over their length, the fixed front stanchions 2 have a set of openings 20 regularly spaced opposite one another inside which the load bar ends 21 are engaged, said load bars thus being parallel and regularly spaced along the stanchions 2.

The load bars 21 are used as a support for the front portion of the display racks 22. As can be seen on FIG. 4, the bottom of the rack 22 is integral on its outer face adjacent to its front end with a fixing element 23 orientated along the length of the rack and which has towards the rear a corner shape 24 intended to come into support on the load bar 21.

The mobile vertical stanchions 10 similarly have over their length a set of openings 25 regularly spaced and opposite one stanchion with respect to the other. The load bar ends 26 are engaged inside these openings 25, the body of said bars being contained inside a portion 27 with a U-shaped profile of a fixing element 28 parallel to the fixing element 23 and integral with the rear portion of the outer face of the bottom of the rack 22.

It can be understood that, with this disposition, when the mobile frame moves inside the vertical plane, the rear load bars 26 follow this movement, whereas the front load bars 21 remain fixed so that the rack 22 tilts around the front load bar 21 towards the front or the rear, depending on whether the movement of the mobile frame is effected upwards or downwards.

A fixed rear side member 29 is used as a support for an electric reversing motor 30 whose output shaft is constituted by an endless screw 31 orientated vertically upwards. The endless screw 31 is engaged in a nut 32 which projects towards the rear from an intermediate side member 13 of the mobile frame. The motor 30 is connected to the power supply and to a control button 33.

The functioning of the device of the invention can be understood immediately from the foregoing description. In the normal usage position shown on FIG. 2, the bottom of the racks 22 is slanted forwards with respect to horizontal so that the bottles 35 contained in these racks are propelled via gravity towards the front, thus coming automatically within hand's reach of buyers whenever the latter pick up bottles from these racks.

Figure 3:
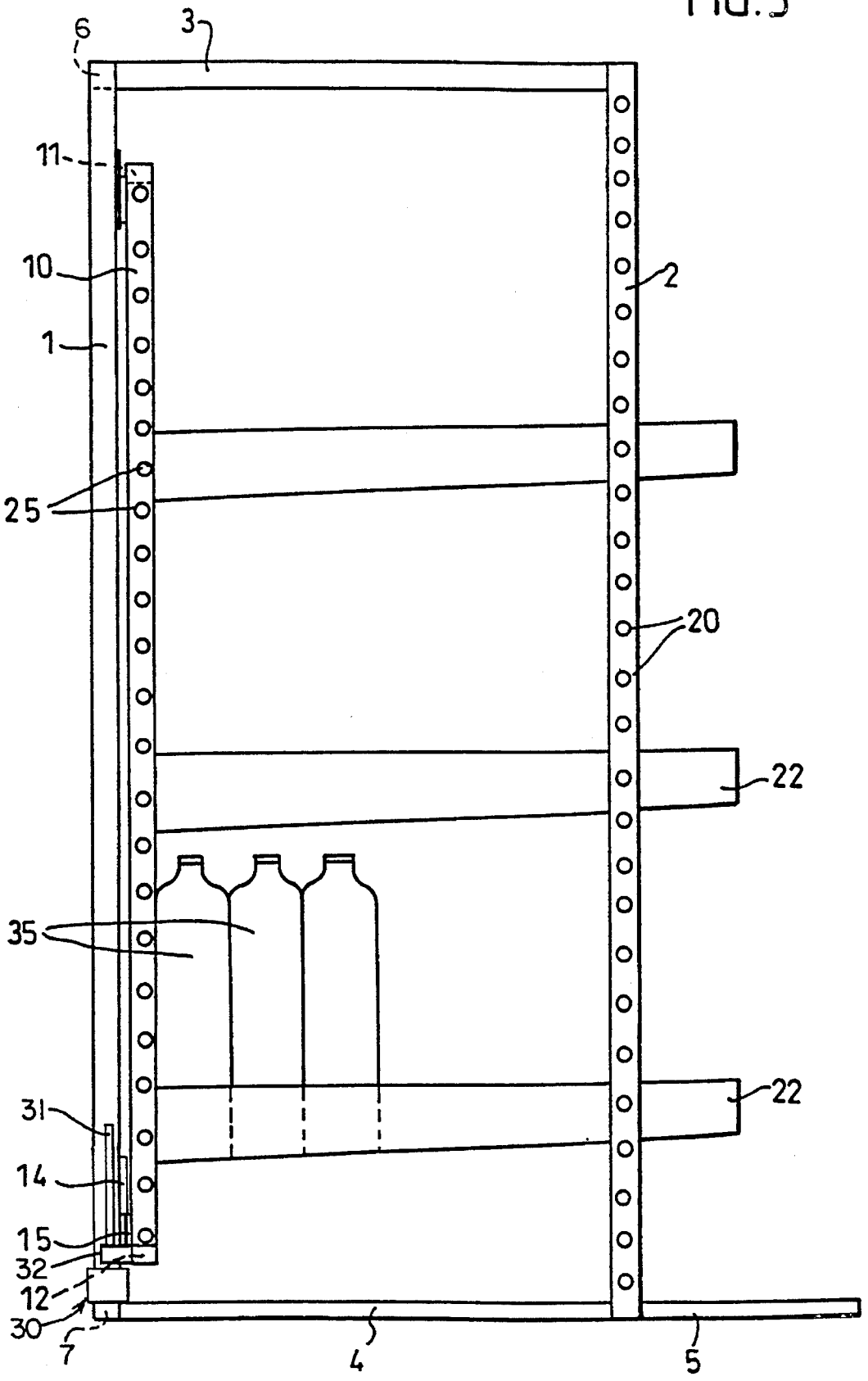
FIG. 3 is a side view similar to FIG. 2 but showing the display cabinet in its loading position (slanting towards the rear)
Figure 7:
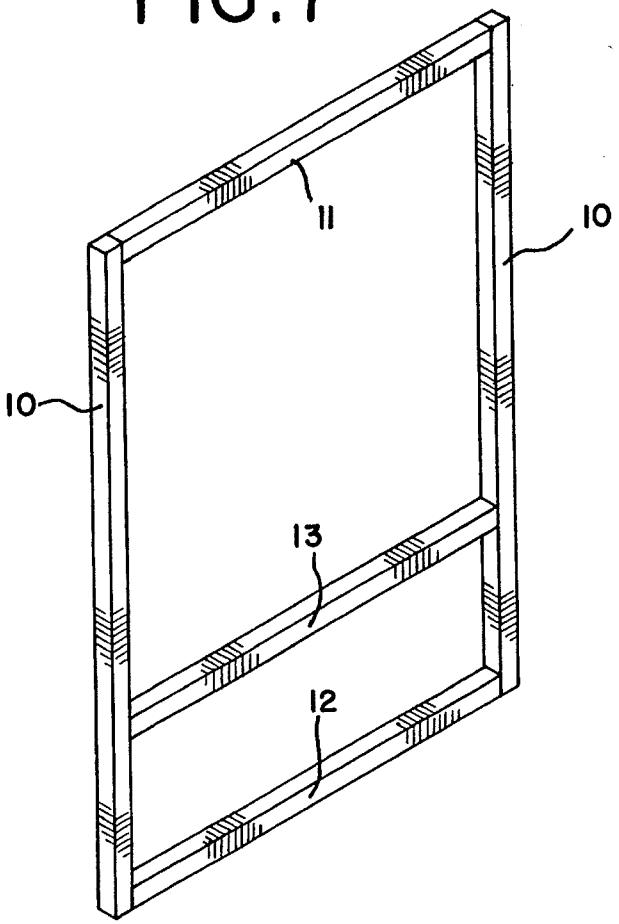
FIG. 7 is a perspective view of the movable frame.
Figure 6:
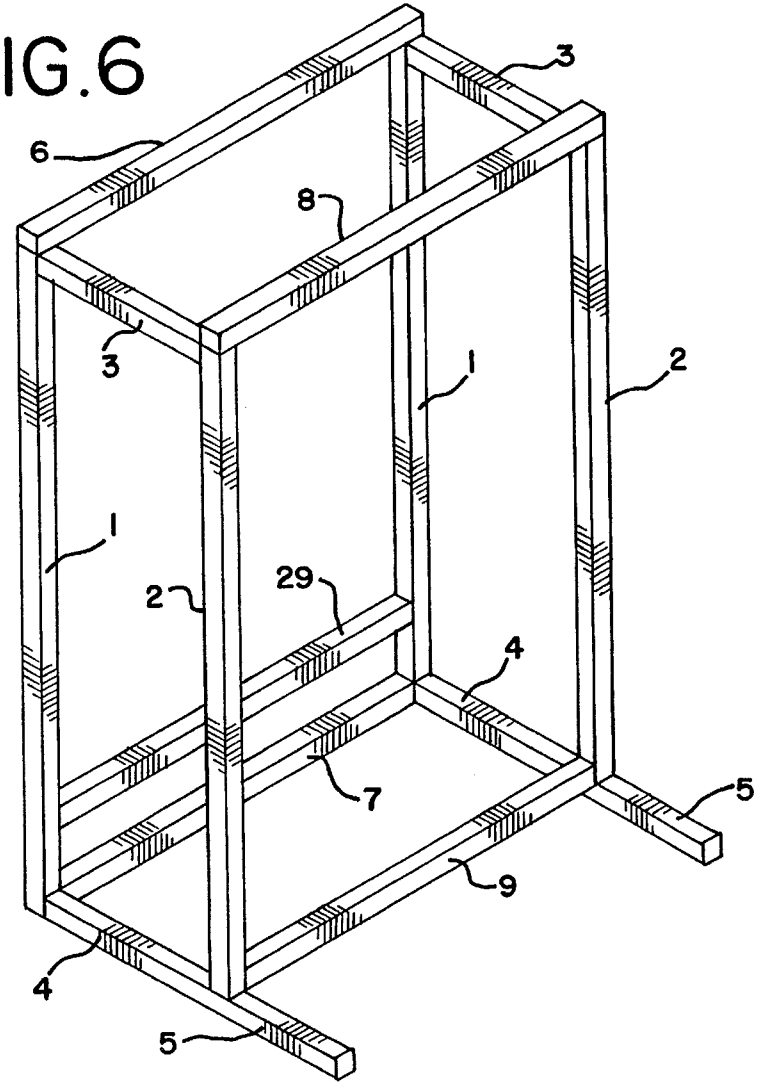
FIG. 6 is a perspective view of the fixed frame.

When the racks 22 need to be reloaded, it merely suffices to activate the button 33 for ordering rotation of the endless screw 31 in a direction provoking the descent of the mobile frame and thus the tilting of the racks 22 anticlockwise around the front load bars 21 until the racks 22 have with respect to horizontal a slanting towards the rear of approximately the same extent as the forward slanting exhibited during normal functioning (position of FIG. 3).

In this position, the bottles subsequently remain in the racks, slide via gravity to the rear portion of the latter, after which it merely suffices for an operator to feed the racks 22 by placing new bottles at the front end of these racks, said bottles sliding automatically via gravity towards the rear of the racks 22, thus allowing for continuous fast reloading without requiring any significant physical force.

Figure 2:
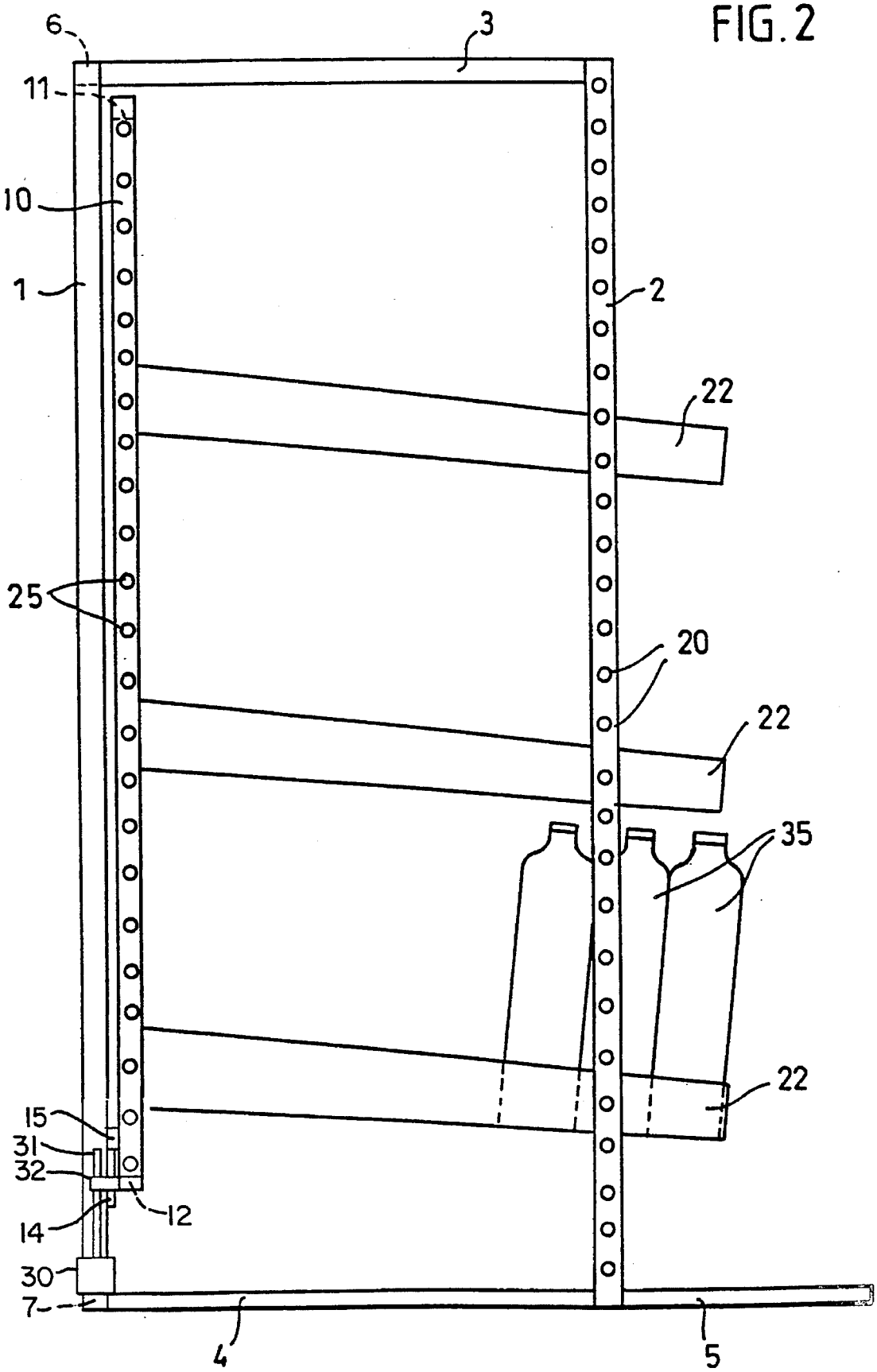
FIG. 2 is a side view of the display cabinet of FIG. 1 in its display position (slanting towards the front)

Once the racks 22 are filled, it merely suffices to activate the motor 30 in an opposite direction so as to order the rise of the mobile frame and thus the clockwise tilting of the racks 22 as far as their slanting forward usage position (position shown on FIG. 2). Advantageously, the motor 30 comprises automatic limits of travel so that the device automatically stops in positions with predetermined forward and backward slanting.

The above description has merely been given by way of non-restrictive example and constructive additions or modifications could be made without departing from the context of the invention. Thus, the tilting of the device has been described as being controlled by means of an electric motor, but, without departing from the context of the invention, this tilting could be controlled by any suitable hydraulic, pneumatic or mechanical device.

The foregoing description is given as applying to the displaying of bottles, but this example is non-restrictive and the invention is applicable to the displaying of all articles of a sufficient given weight.

I claim:

1. Device for displaying articles which comprises:

fixed frame means comprising front and rear vertical stanchions interconnected by front, rear and side crossmembers, adjustable rear frame means slidingly supported by said fixed frame means, which comprises rear vertical stanchions braced by crossmembers, at least one horizontal front load bar supported by said front vertical stanchions of the fixed frame means, at least one horizontal rear load bar supported by said rear vertical stanchions of the adjustable rear frame means, at least one display rack of which a front part is pivotally supported by said front load bar and of which a rear part is supported by said rear load bar, a lost motion connection provided between said fixed frame means and adjustable rear frame means whereby the adjustable rear frame means can be moved relative to said fixed frame means and drive means which includes a motor having a movable element secured to said adjustable rear frame means for moving said rack between a downwardly extending position so that the articles contained in said rack are automatically placed via gravity in front of the rack and an upwardly extending position where the rack slants toward the rear to allow easy reloading of said rack with articles which, via gravity, are automatically disposed at the rear portion of the rack.

2. A device according to claim 1 in which the movable element comprises an endless screw and the frame means includes a nut secured thereto within which said endless screw is moved.

3. A device according to claim 2 in which the lost-motion connection consists of a plate forming part of said adjustable rear frame means, which plate defines an elongated slot and said fixed frame means includes a pin which fits into said slot.

* * * * *

UNITED STATES PATENT AND TRADEMARK OFFICE

CERTIFICATE OF CORRECTION

PATENT NO. : 5,487,474

DATED : January 30, 1996

INVENTOR(S) : Bernard Heimendinger

It is certified that error appears in the above-indentified patent and that said Letters Patent is hereby corrected as shown below:

On the title page, insert:

--[30] Foreign Application Priority Data

May 11, 1993 [FR] France.....9305630--

Signed and Sealed this

Twenty-eighth Day of May, 1996

*Attest:*

Bruce Lehman

BRUCE LEHMAN

*Attesting Officer*

*Commissioner of Patents and Trademarks*